US008850613B2

(12) United States Patent
Kordecki

(10) Patent No.: US 8,850,613 B2
(45) **Date of Patent: *Oct. 7, 2014**

(54) PROTECTIVE CONTACT SPORTS PADS WITH RELEASE MECHANISM

(71) Applicant: Riddell, Inc., Rosemont, IL (US)

(72) Inventor: Michael E. Kordecki, Vernon Hills, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/867,810

(22) Filed: Apr. 22, 2013

(65) Prior Publication Data

US 2013/0227769 A1 Sep. 5, 2013

Related U.S. Application Data

(63) Continuation of application No. 12/821,989, filed on Jun. 23, 2010, now Pat. No. 8,424,112, which is a continuation-in-part of application No. 12/319,429, filed on Jan. 6, 2009, now Pat. No. 7,962,968.

(51) Int. Cl.

| | |
|---|---|
| ***A61F 5/28*** | (2006.01) |
| ***A63B 71/12*** | (2006.01) |
| ***A41D 13/05*** | (2006.01) |
| *A41D 13/015* | (2006.01) |

(52) U.S. Cl.

CPC ..... *A41D 13/0512* (2013.01); *A63B 71/12* (2013.01); *A63B 2243/005* (2013.01); *A41D 13/0518* (2013.01); *A41D 13/0153* (2013.01); *A63B 2071/1208* (2013.01); *A63B 2243/0045* (2013.01); *A63B 2243/007* (2013.01); *A41D 13/0531* (2013.01)

USPC ..... 2/44

(58) Field of Classification Search

USPC ..... 2/102, 94, 461, 462, 463–465, 44, 45, 2/69, 2.5

See application file for complete search history.

(56) References Cited

U.S. PATENT DOCUMENTS

| | | | | |
|---|---|---|---|---|
| 1,298,618 | A | 3/1919 | Wloszek | |
| 2,477,989 | A | 8/1949 | La Maida | |
| 3,431,560 | A | 3/1969 | Austin | |
| 3,514,784 | A | 6/1970 | McDavid | |
| 3,740,762 | A | 6/1973 | Truelove | |
| 3,740,763 | A | 6/1973 | Mitchell | |
| 4,295,227 | A | 10/1981 | Mitchell | |
| 4,317,237 | A * | 3/1982 | Porte | 2/464 |
| 4,322,859 | A | 4/1982 | Mitchell | |
| 4,441,211 | A | 4/1984 | Donzis | |
| 4,467,475 | A | 8/1984 | Gregory et al. | |
| 4,486,901 | A | 12/1984 | Donzis | |

(Continued)

FOREIGN PATENT DOCUMENTS

| | | | |
|---|---|---|---|
| WO | 2008108856 | A2 | 9/2008 |
| WO | 2009051619 | A2 | 4/2009 |

*Primary Examiner* — Tejash Patel

(74) *Attorney, Agent, or Firm* — McDermott, Will & Emery LLP

(57) ABSTRACT

Protective pads wearable by a user for use in a contact sport include a release mechanism that allows the protective pads to be safely and easily detached from each other while the individual wearing the protective pads is maintained in the supine position, thus decreasing the risk of a secondary injury to the individual wearing the protective pads as the protective pads are removed. The release mechanism includes an elongated coupler having an anterior segment that is operable to detach posterior portions of the protective pads from one another.

20 Claims, 5 Drawing Sheets

(56) References Cited

U.S. PATENT DOCUMENTS

| | | | | | |
|---|---|---|---|---|---|
| 4,513,449 | A | | 4/1985 | Donzis | |
| 4,590,622 | A | * | 5/1986 | Wolfe et al. | 2/462 |
| 4,694,505 | A | * | 9/1987 | Flosi et al. | 2/462 |
| 4,872,216 | A | | 10/1989 | Wingo, Jr. | |
| 4,874,640 | A | | 10/1989 | Donzis | |
| 4,926,503 | A | | 5/1990 | Wingo Jr | |
| 4,985,931 | A | | 1/1991 | Wingo, Jr. | |
| 5,029,341 | A | * | 7/1991 | Wingo, Jr. | 2/462 |
| 5,035,009 | A | | 7/1991 | Wingo, Jr. | |
| 5,107,542 | A | | 4/1992 | Zide et al. | |
| D328,159 | S | | 7/1992 | Donzis | |
| 5,159,715 | A | | 11/1992 | Jurga et al. | |
| 5,204,993 | A | * | 4/1993 | Siemens | 2/461 |
| 5,235,715 | A | | 8/1993 | Donzis | |
| 5,337,417 | A | * | 8/1994 | Whiteside et al. | 2/463 |
| 5,404,590 | A | | 4/1995 | Monica, Jr. | |
| 5,530,966 | A | * | 7/1996 | West | 2/462 |
| 5,794,275 | A | | 8/1998 | Donzis | |
| 5,881,395 | A | | 3/1999 | Donzis | |
| 5,987,654 | A | * | 11/1999 | Chartrand | 2/462 |
| 6,175,967 | B1 | | 1/2001 | Donzis | |
| 6,425,195 | B1 | | 7/2002 | Donzis | |
| 6,769,137 | B2 | | 8/2004 | D'Annunzio | |
| 6,948,188 | B2 | * | 9/2005 | D'Annunzio | 2/102 |
| 7,020,897 | B2 | | 4/2006 | Johnson | |
| 7,047,570 | B2 | | 5/2006 | Johnson | |
| 7,243,376 | B2 | | 7/2007 | Johnson | |
| 7,424,748 | B1 | | 9/2008 | McDunn et al. | |
| 7,506,384 | B2 | | 3/2009 | Ide et al. | |
| 7,930,773 | B2 | | 4/2011 | Ide et al. | |
| 7,962,968 | B2 | * | 6/2011 | Kordecki | 2/44 |
| 8,214,929 | B2 | | 7/2012 | Kraemer et al. | |
| 8,424,112 | B2 | * | 4/2013 | Kordecki | 2/44 |
| 2006/0010590 | A1 | | 1/2006 | Huschke et al. | |
| 2008/0263737 | A1 | | 10/2008 | Parks et al. | |

* cited by examiner

PROTECTIVE CONTACT SPORTS PADS WITH RELEASE MECHANISM

CROSS REFERENCE TO RELATED APPLICATIONS

This is a continuation of U.S. patent application Ser. No. 12/821,989, filed Jun. 23, 2010, and published as U.S. 2010/0281607, which is a continuation-in-part of U.S. patent application Ser. No. 12/319,429 filed Jan. 6, 2009, published as U.S. 2010/0170029, and issued as U.S. Pat. No. 7,962,968 on Jun. 21, 2011. This application is related to International Application No. PCT/US2010/020248 filed Jan. 6, 2010, which published as WO2010080825. The entire contents of each of the foregoing applications, publications, and patent are hereby incorporated by reference herein.

TECHNICAL FIELD

Embodiments of the present invention relate generally to protective pads such as those worn by individuals participating in athletic activities, including contact sports, such as, but not limited to, football, lacrosse, and hockey. In particular, embodiments of the present invention improve presently available protective contact sports pads with a feature that allows first responders, emergency medical personnel or others to detach, decouple, and/or remove protective rib and lower back pads from protective shoulder pads that the individual is wearing while the individual is in the supine position.

BACKGROUND

Protective rib and lower back pads are commonly used by athletes and other individuals in conjunction with protective shoulder pads to protect the individual's torso from impact that may result in injury. For example, protective shoulder pads, rib pads and lower back pads are utilized in sports where collision is inherent and produces a significant risk of injury, such as football, lacrosse, and hockey. The protective rib and lower back pads generally attach to the athlete's protective shoulder pads and suspend down from the protective shoulder pads.

When neck or cervical spine injuries occur, protective shoulder pads, rib pads and lower back pads themselves become a risk factor for secondary injury during the course of initial medical evaluation and management. While medical personnel provide stabilization to the wearer's spine, the protective shoulder pads and suspended rib and lower back pads must be removed from the injured athlete while the athlete is lying supine. This will help to protect the athlete from further injury and aid in the diagnosis and treatment of a suspected cervical spine or neck injury. The suspended connection of the protective rib and lower back pads to the shoulder pads provides a greater burden in the removal of the protective shoulder pads due to the weight of the individual's torso on the protective rib and lower back pads while the individual is lying supine.

Currently available protective shoulder pads, rib pads and lower back pads only allow removal as an entire unit. The proper technique for protective shoulder pad removal includes one member of the medical team maintaining manual stabilization of the athlete's head and neck at all times. While that member of the medical team remains in place manually stabilizing the head and neck, the injured athlete's torso is elevated to a 30-40 degree angle by flexing the athlete's lower spine and hips which requires at least four trained people. Alternatively, the entire athlete must be lifted which could require up to eight people. While in this compromised position, the protective shoulder pads, rib pads and lower back pads are then maneuvered in a manner to remove them, essentially, over the head and then under the body of the injured athlete. This maneuver is extremely complicated and may potentially cause a secondary injury. Research in the field of spinal cord injury has suggested up to 25% of cervical spinal cord injured patients experience neurologic deterioration during the course of initial evaluation and management.

In the event that an individual suffers a suspected injury to the spine or neck, the current practice in the medical profession is to stabilize the individual in the supine position while diagnosing and treating the individual. The National Athletic Trainers' Association's guidelines and recommendations in this field, Prehospital Care of the Spine-Injured Athlete, require that any athlete who is suspected of having a head and/or spinal injury should be managed as though a spinal injury exists, and if unconscious, the player is presumed to have an unstable fracture until it is proved otherwise. The guidelines further state that the improper management of a suspected spinal injury can result in a secondary injury. Head and shoulder stabilization must be maintained during any manipulation and removal of equipment to avoid cervical movement, lateral flexion and other movements which could lead to further injury.

While providing stabilization to the wearer's spine, the protective shoulder pads, rib pads and lower back pads must be removed from the injured athlete while lying supine to aid in the diagnosis and treatment of a suspected cervical spine or neck injury. The current National Athletic Trainers' Association's guidelines and recommendations require at least four individuals to remove currently available shoulder pads, rib pads and lower back pads. Routinely up to eight individuals may be needed to remove the currently available pads. Realizing the importance of limiting the amount of unnecessary movement during this process to prevent a secondary injury, the guidelines recommend removing the protective pads only to an extent that full access to chest, face, neck, and arms may be accessed. The National Athletic Trainers' Association's suggested method comprises the steps of cutting all soft clothing and soft portions of the shoulder pads with a knife or equivalent cutting apparatus as required to spread the two anterior halves of the protective shoulder pads that are currently available. However, the repositioning of the protective shoulder pads to this limited extent precludes sufficient access to the neck and cervical spine areas that medical personnel must access to diagnose and treat an individual with a suspected cervical spine injury.

Recent published studies by Rechtine and Horodysky at the University of Rochester have demonstrated significant motion in the cervical spine during shoulder pad removal despite the utilization of optimal techniques that are currently recommended by national athletic training and trauma specialty organizations. The consequences of such motion may include loss of one or more levels of neurologic function in the acute spinal cord injured athlete. This alone could result in a potentially ambulatory athlete becoming non-ambulatory, an independent athlete becoming dependent, or an athlete who may have independent respiration becoming respirator dependent. The human cost and the cost to society of such deterioration is enormous. No current protective shoulder pad, rib or lower back pad design allows for the safe removal of the protective pads from an individual immobilized in the supine position by less than four properly trained people. Furthermore, current protective shoulder pad, rib and lower back pad designs prevent both stabilization of the potentially injured athlete and an acceptable quality of radiographic imaging.

In their article Helmet and Shoulder Pad Removal in Football Players with Unstable Cervical Spine Injuries, M. C. Dahl, D. Ananthakrishnan, G. Nicandri, and R. P. Ching, the authors, while recognizing that "patient handling is often impaired due to the protective equipment worn and improper stabilization of these patients can exacerbate neurologic injury," the authors discussed alternative methods for removing protective shoulder pads and the resulting detriments caused by each method. The levitation technique was found to produce motion in the anterior and right lateral directions. The tilt technique resulted in motions in the posterior left lateral directions, and the log roll technique generated motions in the right lateral direction and had the largest amount of increased instability when comparing the intact and lesioned specimen. According to the authors, "these findings suggest that each method of equipment removal displays unique weaknesses that the practitioner should take into account."

In another study, the amount of motion that occurred during protective shoulder pad removal in a cadaver with an injured spine was evaluated and quantified. Helmet and shoulder pad removal from a player with suspected cervical spine injury. A cadaveric model. Spine. W F Donaldson, W C Lauerman, B Heil, R Blanc, T Swenson. 1998. The authors of the study concluded that shoulder pad removal in the unstable cervical spine is a complex maneuver, and that because of the motion observed in the unstable spine, shoulder pad removal should be performed in a carefully monitored setting by at least three, preferably four, trained people.

Another problem with currently available shoulder pads, rib pads and lower back pads is that different types of protective shoulder pads, rib pads and lower back pads are available for specific purposes, and the different types exacerbate the problems in removing the shoulder pads. Specific models of protective shoulder pads have posterior portions of the shoulder pads that protect down to the small of the user's back, and/or include rib pads and lower back pads. The injured athlete must be moved to a greater degree to remove the shoulder pads, thus increasing the potential for a secondary injury. The weight of the wearer's torso exerted on the posterior member of the shoulder pads and/or rib and lower back pads prevents easy removal of the shoulder pads, and as discussed, it is undesirable to move the individual wearing the protective shoulder pads. Another complication of attempting to remove protective shoulder pads over the head of an individual is the weight and mass of the individual. Large and heavy individuals are more difficult to lift and their body mass proves detrimental to the removal of the protective shoulder pads, thus requiring more movement of the individual and increasing the potential for a secondary injury in a person with a suspected neck or cervical spine injury.

Thus, existing protective shoulder pads, rib pads and lower back pads become an impediment to diagnosing and treating an individual while in the supine position and the removal of the shoulder pads, rib pads and lower back pads may potentially cause a secondary injury. The removal of the protective shoulder pads, rib pads and lower back pads requires significant movement of the wearer by at least four trained medical personnel. No protective shoulder pads, rib pads and lower back pads are available that allows for removal of the shoulder pads, rib pads and lower back pads and allows for sufficient access to the wearer's neck and spine while maintaining the neck and spine in a substantially neutral position while in the supine position. What is needed in the industry are shoulder pads, rib pads and lower back pads that allow for the safer removal of the protective shoulder pads, rib pads and lower back pads from an individual immobilized in the supine position. Furthermore, what is needed in the industry are shoulder pads, rib pads and lower back pads that promote both stabilization of the potentially injured athlete and allow an acceptable quality of radiographic imaging.

These improved protective shoulder pads, rib pads and lower back pads provide a solution to the challenges of diagnosing and treating suspected neck and spinal injuries. By allowing the removal of the shoulder pads while maintaining the neck and spine in the substantially neutral position, these improved shoulder pads, rib pads and lower back pads substantially reduce the risk of further injury to an individual wearing shoulder pads with a suspected neck or spinal injury. The benefit of these improved protective shoulder pads, rib pads and lower back pads is the ease and effectiveness of removal of those portions of the pads that typically present obstacles to the effective diagnosis and treatment.

Once these portions are removed, medical personnel can more effectively diagnose and treat the individual suspected of a cervical spine or neck injury. The release mechanism according to an embodiment of the present invention for the rib pads and lower back pads address the risk of increasing neurologic injury in the spinal cord injured athlete by reducing the spinal motion demonstrated by Rechtine during shoulder pad removal. Embodiments of the present invention provide for removal of the rib and lower back pads by a release mechanism which is easily accessible by first responders, medical professionals and others.

The novel removable protective contact sports pads according to an embodiment of the present invention provide a solution to the challenges of diagnosing and treating suspected neck and spinal injuries. By providing for the disconnection or decoupling of the protective rib and lower back pads from the protective shoulder pads while maintaining the neck and spine of the individual in the substantially neutral position, these novel detachable protective pads substantially decrease the risk of further injury to an individual wearing protective shoulder pads. Embodiments of the invention provide for detachment or decoupling of the protective rib and lower back pads from the protective shoulder pads by a release mechanism which is easily accessible by first responders, medical professionals and others while the wearer is in the supine position. An anterior portion of the release mechanism is accessed from the anterior portion of the shoulder and rib pads while the wearer is in the supine position. Once the protective rib pads and lower back pads are decoupled from the protective shoulder pads, medical personnel can more effectively remove the protective shoulder pads and diagnose and treat the individual suspected of a cervical spine or neck injury and the injured athlete's spine may be accessed for radiographic evaluation.

SUMMARY

Responsive to the foregoing challenges, Applicant has developed a novel protective rib/back pad with a release mechanism.

Embodiments of the present invention are shoulder, rib, and lower back pads for use in a contact sport comprising a first pad assembly in the form of a shoulder pad having an anterior portion, a superior portion and a posterior portion, wherein a first end of the anterior portion is in communication with a first end of the superior portion, and a first end of the posterior portion is in communication with a second end of the superior portion, a second pad assembly in the form of a rib and lower back pad having a posterior portion and an anterior portion, wherein the rib and lower back pad is releasably coupled to the posterior portion of the shoulder pad, and a release mechanism operable to decouple the rib and lower back pad from the shoulder pad when the individual wearing the shoulder pad and rib and lower back pad is in the supine position.

The release mechanism may comprise a strap comprising a retaining loop disposed on the posterior portion of the shoulder pad, a retention aperture disposed on the rib and lower back pad, and an elongated coupler, wherein the retaining loop threads through the retention aperture and is retained in the retention aperture by the elongated coupler, and wherein the retaining loop is released from the retention aperture upon removal of the elongated coupler. A first end of the strap may be attached to the shoulder pad and a second end of the strap may comprise the retaining loop. The first end of the strap may be attached to the posterior portion of the shoulder pad. The retaining loop may comprise an orifice. The retention aperture may be disposed on the posterior portion of the rib and lower back pad.

A first end of the elongated coupler may be disposed on the anterior portion of the rib and lower back pad and a second end of the elongated coupler may be disposed on the posterior portion of the rib and lower back pad when the rib and lower back pad is coupled to the shoulder pad. A portion of the elongated coupler may traverse substantially the length of the posterior portion of the rib and lower back pad when the rib and lower back pad is coupled to the shoulder pad. The release mechanism may comprise at least two straps and at least two apertures. The rib and lower back pad is suspended from the shoulder pad by the release mechanism.

One embodiment of the present invention is shoulder, rib, and lower back pads for use in a contact sport comprising a first pad assembly in the form of a shoulder pad having an anterior portion, a superior portion and a posterior portion, wherein a first end of the anterior portion is in communication with a first end of the superior portion, and a first end of the posterior portion is in communication with a second end of the superior portion, a second pad assembly in the form of a rib and lower back pad having a posterior portion and an anterior portion, wherein the posterior portion of the rib and lower back pad is releasably coupled to a second end of the posterior portion of the shoulder pad, and a release mechanism operable to decouple the rib and lower back pad from the shoulder pad when the individual wearing the shoulder pad and rib and lower back pad is in the supine position. The release mechanism comprises a strap comprising a retaining loop disposed on the posterior portion of the shoulder pad assembly, a retention aperture disposed on the superior portion of the rib and lower back pad assembly, and an elongated coupler having a first end and a second end, wherein the retaining loop threads through the retention aperture and is retained in the retention aperture by a portion of the elongated coupler, wherein the retaining loop is released from the retention aperture upon removal of the elongated coupler, and wherein the first end of the elongated coupler is disposed on the anterior portion of the rib and lower back pad and the second end of the elongated coupler is disposed on the posterior portion of the rib and lower back pad when the rib and lower back pad is coupled to the shoulder pad. The rib and lower back pad is suspended from the shoulder pad by the strap when the rib and lower back pad is coupled to the shoulder pad.

The first end of the elongated coupler may terminate on the anterior portion of the rib and lower back pad and the second end of the elongated coupler may terminate on the posterior portion of the rib and lower back pad when the rib and lower back pad is coupled to the shoulder pad. A portion of the elongated coupler may traverse substantially the length of the posterior portion of the rib and lower back pad.

An embodiment of the present invention is shoulder, rib, and lower back pads for use in a contact sport comprising a first pad assembly in the form of a shoulder pad having an anterior portion, a superior portion and a posterior portion, wherein a first end of the anterior portion is in communication with a first end of the superior portion, and a first end of the posterior portion is in communication with a second end of the superior portion, a second pad assembly in the form of a rib and lower back pad having a posterior portion and an anterior portion, wherein the rib and lower back pad is releasably coupled to the posterior portion of the shoulder pad, a release mechanism comprising a strap having a retaining loop disposed on the posterior portion of the shoulder pad, a retention aperture disposed on the rib and lower back pad, and an elongated coupler, wherein the retaining loop threads through the retention aperture and is retained in the retention aperture by the elongated coupler, wherein the retaining loop is released from the retention aperture upon removal of the elongated coupler, and wherein the release mechanism operable to decouple the rib and lower back pad from the shoulder pad when the individual wearing the shoulder pad and rib and lower back pad is in the supine position. A portion of the elongated coupler may be disposed on the anterior portion of the rib and lower back pad and a portion of the elongated coupler may traverse substantially the length of the posterior portion of the rib and lower back pad.

An embodiment of the present invention is a first pad assembly in the form of a shoulder, rib, and lower back pads for use in a contact sport comprising a shoulder pad having an anterior portion, a superior portion and a posterior portion, wherein a first end of the anterior portion is in communication with a first end of the superior portion, and a first end of the posterior portion is in communication with a second end of the superior portion, a second pad assembly in the form of a rib and lower back pad having a posterior portion and an anterior portion, wherein the rib and lower back pad is releasably coupled to the posterior portion of the shoulder pad, a release mechanism comprising a strap having a retaining loop disposed on the posterior portion of the rib and lower back pad, a retention aperture disposed on shoulder pad, and an elongated coupler, wherein the retaining loop threads through the retention aperture and is retained in the retention aperture by the elongated coupler, wherein the retaining loop is released from the retention aperture upon removal of the elongated coupler, and wherein the release mechanism operable to decouple the rib and lower back pad from the shoulder pad when the individual wearing the shoulder pad and rib and lower back pad is in the supine position. A portion of the elongated coupler may be disposed on the anterior portion of the shoulder pad and a portion of the elongated coupler may be disposed on the posterior portion of the shoulder pad.

An embodiment of the present invention is protective pads wearable by an individual for use in a contact sport, the protective pads comprising a first pad assembly having an anterior portion and a posterior portion, a second pad assembly having a posterior portion and an anterior portion, and an elongated coupler releasably coupling the posterior portion of the second pad assembly to the posterior portion of the first pad assembly. The elongated coupler including an anterior segment that is accessible from the anterior portion of the second pad assembly and that is operable to decouple the second pad assembly from the first pad assembly while an individual wearing the first and second pad assemblies is in the supine position.

An embodiment of the present invention is protective pads wearable by an individual for use in a contact sport, the protective pads comprising a first pad assembly having an anterior portion, a superior portion and a posterior portion, wherein a first end of the anterior portion is in communication with a first end of the superior portion, and a first end of the posterior portion is in communication with a second end of the superior portion. A second pad assembly has a posterior portion and an anterior portion, and a release mechanism includes a first portion provided on the posterior portion of the first pad assembly and a second portion releasably coupled with the first portion and provided on the posterior portion of the second pad assembly. The release mechanism further including an elongated coupler including an anterior segment accessible from the anterior portion of the second pad assembly, wherein the anterior segment of the elongated coupler is operable to decouple the first portion of the release mechanism from the second portion of the release mechanism, thereby decoupling the posterior portion of the first pad assembly from the posterior portion of the second pad assembly.

An embodiment of the present invention is protective pads wearable by an individual for use in a contact sport, the protective pads comprising a first pad assembly having an anterior portion and a posterior portion, a second pad assembly having a posterior portion and an anterior portion, and a release mechanism including a first portion provided on the posterior portion of the first pad assembly and a second portion releasably coupled with the first portion and provided on the posterior portion of the second pad assembly. The release mechanism further including an elongated coupler including a posterior segment and an anterior segment, wherein the anterior segment of the elongated coupler is operable to decouple the first portion of the release mechanism from the second portion of the release mechanism while an individual wearing the coupled first and second pad assemblies is in the supine position.

Utilizing mechanical fasteners or equivalent, the second pad assembly may be easily and efficiently detached from the posterior portions of the corresponding first pad assembly while the individual wearing the first and second pad assemblies is in the supine position. As a result, the individual suspected of a cervical spine or neck injury need not be significantly repositioned during the detachment of the second pad assembly, thus substantially decreasing the possibility of the wearer suffering a secondary cervical spine or neck injury. The second pad assembly may be removed laterally from underneath the individual if desired. The second pad assembly may be subsequently reattached to the corresponding first pad assembly for future use if desired.

Upon removal of the protective rib and lower back pads and their corresponding protective shoulder pads, medical personnel and others gain access to the location of the suspected cervical spine and neck injury to treat the injury. Additionally, radiographic imaging machines can be positioned to provide clearer images of the suspected injury upon removal of the protective rib and lower back pads and their corresponding protective shoulder pads.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE SEVERAL VIEWS OF THE DRAWINGS

In order to assist the understanding of this invention, reference will now be made to the appended drawings, in which like reference characters refer to like elements. The drawings are exemplary only, and should not be construed as limiting the invention.

DETAILED DESCRIPTION

Figure 1:
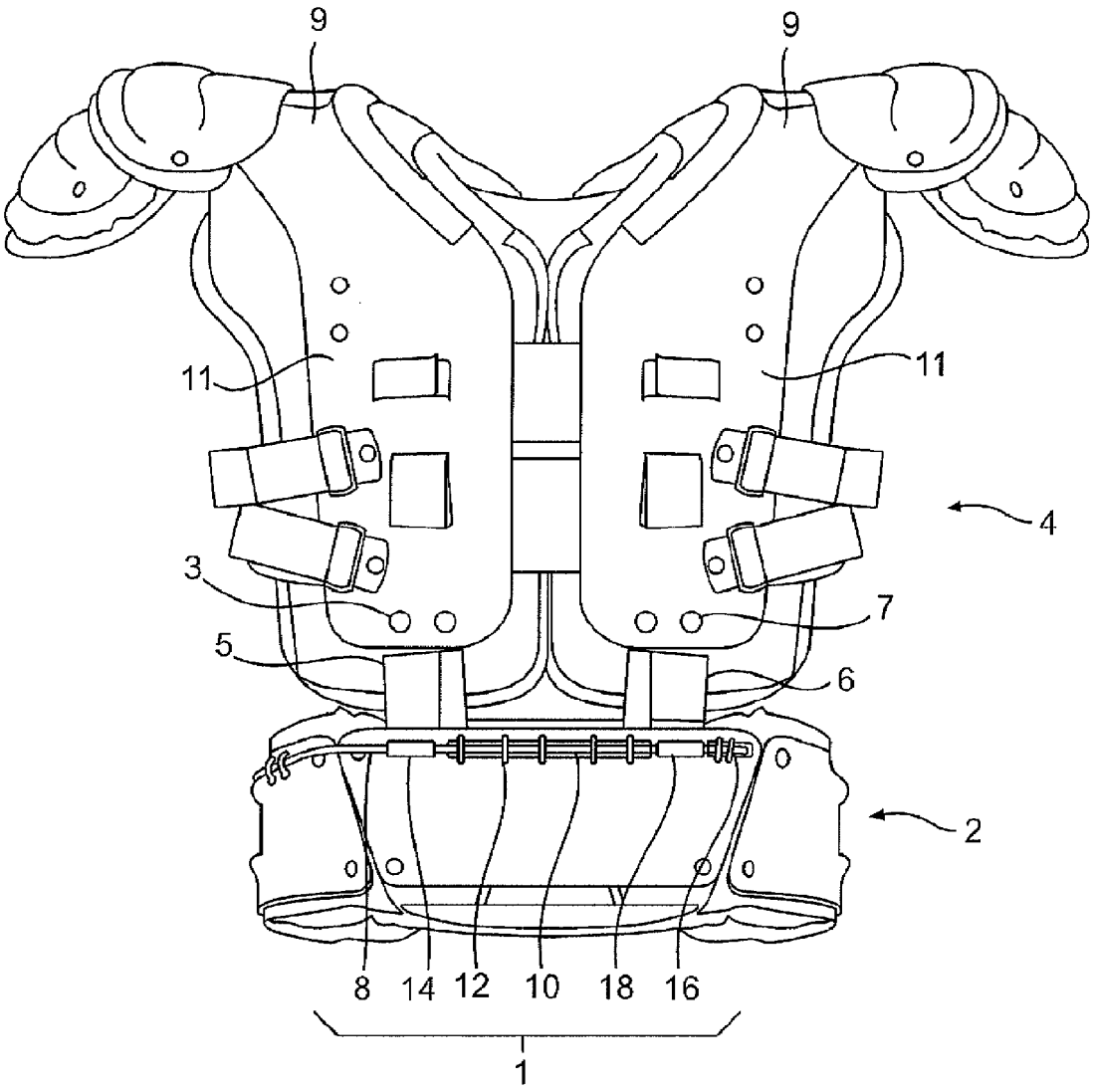
FIG. 1 illustrates a distal plan view of one embodiment of the present invention with a removable elongated coupler shown as the removable connection that couples the protective rib and lower back pads to the protective shoulder pads.

Embodiments of this invention relate generally to protective contact sports pads such as those worn by individuals participating in athletic activities, including contact sports, such as, but not limited to, football, hockey, and lacrosse. In particular, these embodiments improve currently available contact sports pads with a feature that allows emergency medical personnel and/or others to more safely and easily remove the pads in case of suspected neck or cervical spine injury while the individual is in the supine position. Reference will now be made in detail to embodiments of the present invention, examples of which are illustrated in the accompanying drawings.

Typical shoulder pads 4 are comprised of anterior (not shown), superior 9 and posterior 11 portions, wherein the anterior portions depend from an anterior face of superior portions 9, and posterior portions 11 depend from a posterior face of superior portions 9. Superior portions 9 comprise a central opening. Protective shoulder pads 4 protect the chest, shoulders, upper back, and upper arms of the individual wearing shoulder pads 4. The anterior portions of shoulder pads 4 protect the individual's chest, superior portions 9 of protective shoulder pads 4 protect the individual's shoulders, posterior portions 11 of protective shoulder pads 4 protect the individual's upper back, and, if present, lateral portions (not shown) of protective shoulder pads 4 protect the individual's upper arms.

According to an embodiment of the present invention shown in FIG. 1, shoulder pads 4 further comprise rib and lower back pads 2 suspended from a portion of shoulder pads 4, including, but not limited to, posterior portion 11 of shoulder pads 4. Protective rib and lower back pads 2 protect the ribs and lower back of the individual wearing protective rib and lower back pads 2. In the assembled or coupled position, protective rib and lower pads 2 are mechanically coupled to their corresponding protective shoulder pads 4 with release mechanism 1. Actuation of release mechanism 1 permits removal of rib and lower back pads 2 from shoulder pads 4 while the wearer is in the supine position.

As shown in FIGS. 1 through 5, actuating release mechanism 1 decouples or detaches protective rib and lower back pads 2 from their corresponding protective shoulder pads 4 while the individual wearing protective shoulder pads 4 is in the supine position, without significantly moving the individual. In one embodiment, release mechanism 1 may comprise strap 5 having a first end and a second end, wherein the first end is in communication with a first pad, and wherein the second end extends from the first pad and comprises retaining loop 14, retention aperture 21 disposed on a second pad, wherein aperture 21 is sized to fit a width of retaining loop 14, and elongated coupler 8 sized to fit through orifice 17 disposed in retaining loop 14. The first pad and the second pad are mechanically coupled when retaining loop 14 associated with the first pad is passed through retention aperture 21 associated with the second pad and secured in place by threading a second end of elongated coupler 8 through orifice 17 in retaining loop 14. The presence of elongated coupler 8 prevents retaining loop 14 from passing back through or egressing from retention aperture 21. Actuating release mechanism 1 by grasping and pulling a first end or anterior portion 20 of elongated coupler 8 and removing elongated couple 8 from orifice 17 in retaining loop 14, permits retaining loop 14 to pass back through or egress from retention aperture 21, thereby decoupling the first pad from the second pad. In one embodiment the first pad is shoulder pad 4 and the second pad is rib and lower back pad 2. In an alternative embodiment, the first pad is rib and lower back pad 2 and the second pad is shoulder pad 4.

When the first and second pads are in the coupled or attached position, a portion of elongated coupler 8 is disposed on, and may traverse substantially the length of, a posterior portion of the pads, and the first or anterior portion 20 is disposed on an anterior portion of the pads. The removal of elongated coupler 8 decouples or detaches shoulder pads 4 from rib and lower back pads 2 while the wearer remains in the supine position. Elongated coupler 8 may be comprised of a cable, cord, belt, pin, strap, tie, filament, wire, tether, or any other suitable structure, or a combination thereof, and may be comprised of metal, plastic, polymer, synthetic, textile, elastic, or any other suitable material, or a combination thereof. Elongated coupler 8 may possess uniform rigidity or possess portions that vary in rigidity. Strap 5 may be comprised of a cable, cord, belt, pin, strap, tie, filament, wire, tether, or any other suitable structure, or a combination thereof, and may be comprised of metal, plastic, polymer, synthetic, textile, elastic, or any other suitable material, or a combination thereof. There may be a single strap 5, or at least two straps. In the case of a single strap 5, strap 5 is sized to allow rib and lower back pad 2 to suspend from shoulder pad 4.

By way of example only, the following discussion describes an embodiment comprising two straps 5, 6 and two apertures 21, 15, wherein the straps are disposed on shoulder pads 4 and the apertures are disposed on rib and lower back pads 2. It is envisioned that any number of straps and apertures may be used, including one strap and one aperture, and that the strap may be disposed on the shoulder pad and the aperture on the rib and lower back pad, or vice versa. According to one embodiment of the present invention, release mechanism 1 comprises elongated coupler 8, two straps 5, 6 and two apertures 21, 15. In this non-limiting example, release mechanism 1 may comprise left strap 5 and right strap 6. The first end of left strap 5 and the first end of right strap 6 are in communication with, attached to, or otherwise disposed on protective shoulder pads 4. Straps 5, 6 may be attached to pads 4 by connectors 3, 7, respectively, or the first end of straps 5, 6 may be molded into pads 4 without the use of connectors 3, 7. By way of example, the first end of strap 5 is attached to pads 4 by connector 3 and the first end of right strap 6 is attached to the protective shoulder pads 4 with connector 7. Connectors 3, 7 may be any suitable connector, including, but not limited to, rivets, snaps, glue, hook and loop fastener, etc.

The opposite or second end of left strap 5 forms left retaining loop 14 having orifice 17. The opposite or second end of right strap 6 forms right retaining loop 18 having orifice 19. Loops 14, 18 are sized such that a portion of loops 14, 18 having orifices 17, 19 may pass through retaining apertures 21, 15, respectively. In this example, loops 14, 18 are passed through apertures 21, 15 by inserting the leading end of loops 14, 18 through apertures 21, 15 in a direction initiating from the wearer's side or internal surface of the pads and exiting on the external side of the pads, or the surface facing away from the wearer. Left retaining loop 14 passes through left retention aperture 21 in protective rib and lower back pads 2 and right retaining loop 18 passes through right retention aperture 15 in protective rib and lower back pads 2, when rib and lower back pads 2 are in their attached or coupled position to shoulder pads 4. When pads 2 are in a coupled or attached position with pads 4, orifice 17 of loop 14 is inserted through aperture 21 and orifice 19 of loop 18 is inserted through aperture 15. A second or posterior end of elongated coupler 8 is passed or threaded through orifice 17 of retaining loop 14, then through coupler guidance channel 10, then through orifice 19 of retaining loop 18, and the first end of coupler 8 terminates in terminating channel 16. In the attached or coupled position, the presence of removable elongated coupler 8 prevents left retaining loop 14 and right retaining loop 18 from egressing back through retention apertures 21 and 15, respectively, in the body of the protective rib and lower back pads 2. In one embodiment, removable coupler 8 is guided along its desired path via guidance channel 10 to facilitate ease of removal. In one embodiment, guidance channel 10 and terminating channel 16 attach to protective rib and lower back pads 2 with channel attaching ties 12. As an alternative to this embodiment of the invention, guidance channel 10 can be manufactured into protective rib and lower back pads 2 forming guidance channel 10, or any suitable retainer or eyelet may be molded into or attached to pads 2 to serve as guidance channel 10.

In the assembled or coupled position, loops 14, 18 are received by apertures 21, 15, wherein loops 14, 18 pass through or are threaded through the apertures 21, 15. Loops 14, 18 are retained in their position through or in the apertures 21, 15 by the insertion of removable elongated coupler 8 through the loop 14, 18 received by and passing through apertures 21, 15, thereby assembling the shoulder pads 4 and the rib and lower back pads 2.

Actuation or removal of elongated coupler 8 from loops 14, 18 permits egress of loops 14, 18 back through or from apertures 21, 15 and permits decoupling or disassembly of shoulder pads 4 and rib and lower back pads 2 while the wearer remains in the supine position. Elongated coupler 8 is routed from posterior portion 23 of the rib and lower pads 2 and the first or anterior portion 20 terminates on or near anterior portion 24 of rib and lower back pads 2. During actuation, with the individual wearing the pads 2 maintained substantially in the supine position, elongated coupler 8 is removed through retaining loops 14, 18, guidance channel 10, and terminating channel 16 by pulling anterior portion 20 of elongated coupler 8, effectively releasing elongated coupler 8 from retaining loops 14, 18, guidance channel 10, and terminating channel 16. Retaining loops 14, 18 are now capable of passing back or egressing through apertures 21, 15, decoupling pads 2 from pads 4. Anterior portion 20 of elongated coupler 8 is accessed from the anterior portion 24 of pads 2 while the wearer is in the supine position, thereby minimizing movement of the individual.

Figure 2:
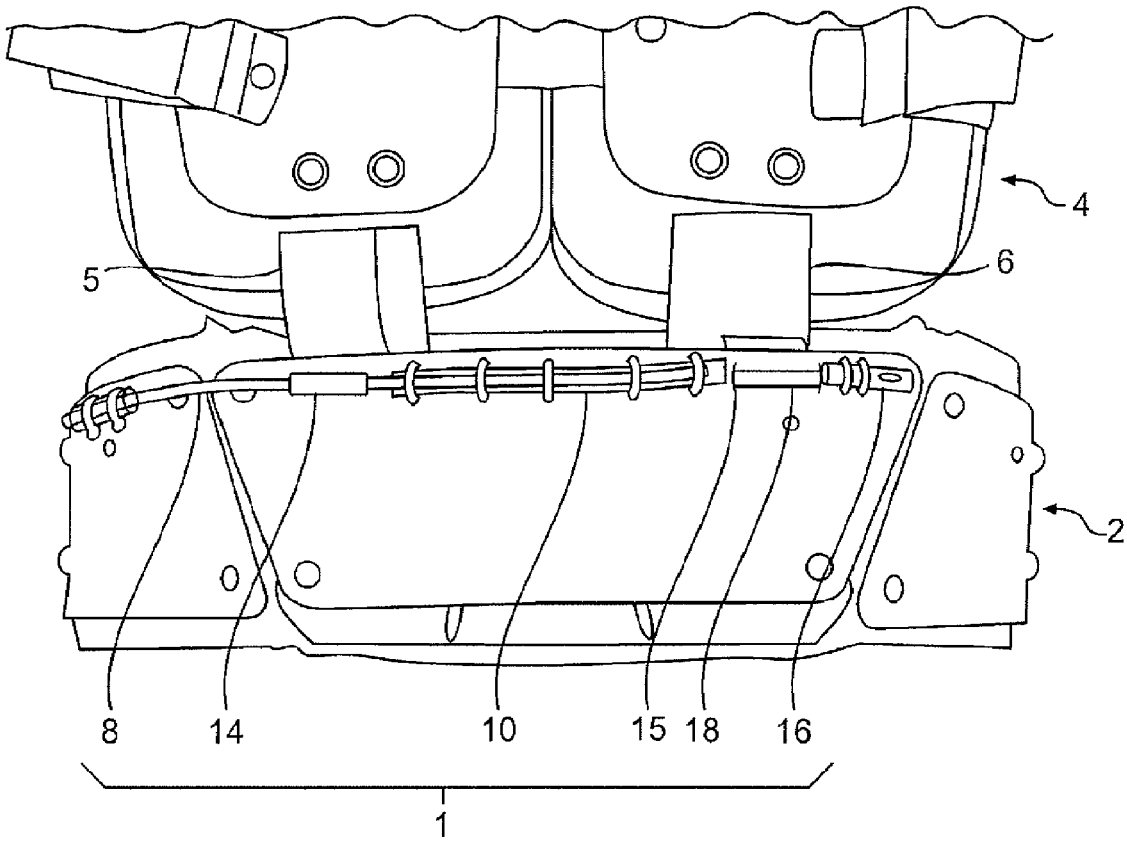
FIG. 2 illustrates a distal plan view of the same embodiment of the present invention as shown in FIG. 1, in which the removable elongated coupler is removed from one protective rib and lower back pad retaining loop with the protective rib and lower back pad retaining loop remaining inserted in the protective rib and lower back pads retention aperture.

As can be seen in FIG. 2, removable elongated coupler 8 is partially removed from protective rib and lower back pads 2 by grasping and pulling anterior end 20 of elongated coupler 8 that is disposed on anterior portion 24 of pad 2. By grasping and pulling anterior end 20 of elongated coupler 8, elongated coupler 8 is removed from terminating channel 16 and orifice 19 of right retaining loop 18. Right retaining loop 18 is released and may pass back through or egress through right retention aperture 15 in protective rib and lower back pads 2, thus decoupling or disconnecting the right portion of protective shoulder pads 4 from protective rib and lower back pads 2.

Figure 3:
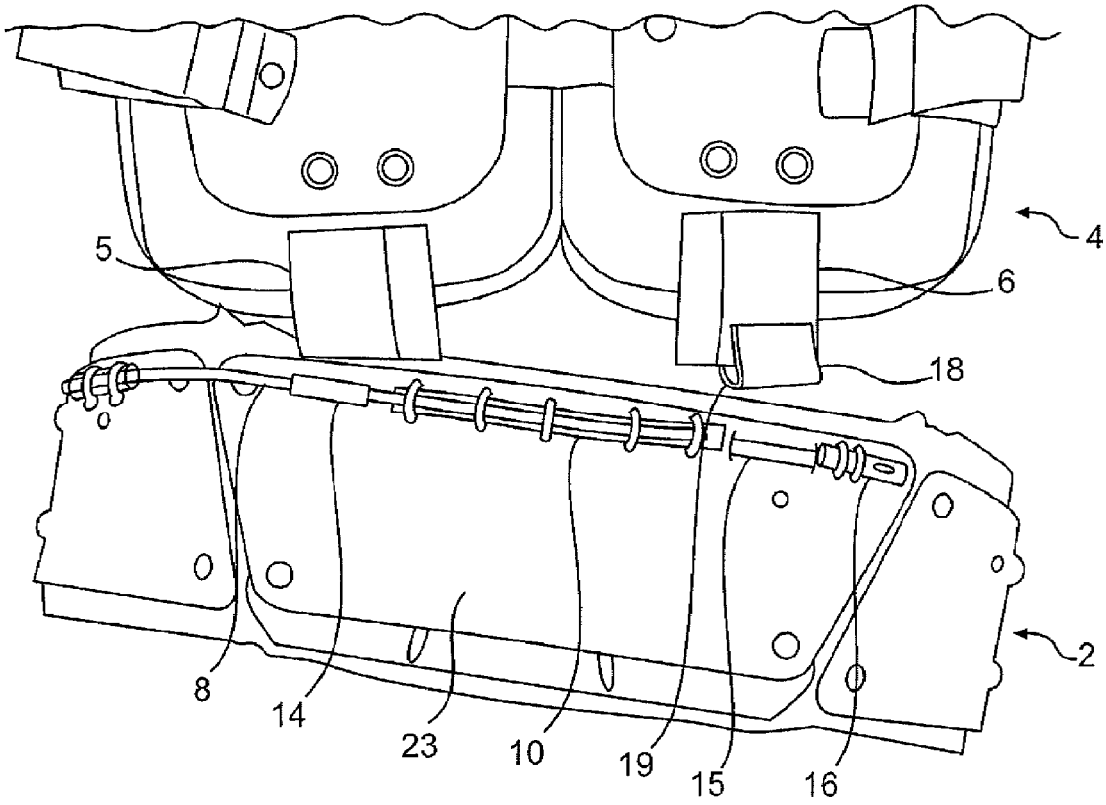
FIG. 3 illustrates a distal plan view of the same embodiment of the present invention as shown in FIG. 1, in which the removable elongated coupler is removed from one protective rib and lower back pad retaining loop with the protective rib and lower back pad retaining loop evacuated from the protective rib and lower back pads retention aperture.

FIG. 3 illustrates right retaining loop 18 removed from right retention aperture 15 in protective rib and lower back pads 2 and the right portion of protective shoulder pads 4 decoupled or disconnected from protective rib and lower back pads 2, with removable elongated coupler 8 in the same position as in FIG. 2. Removable elongated coupler 8 was routed through orifice 19 in right retaining loop 18.

Figure 4:
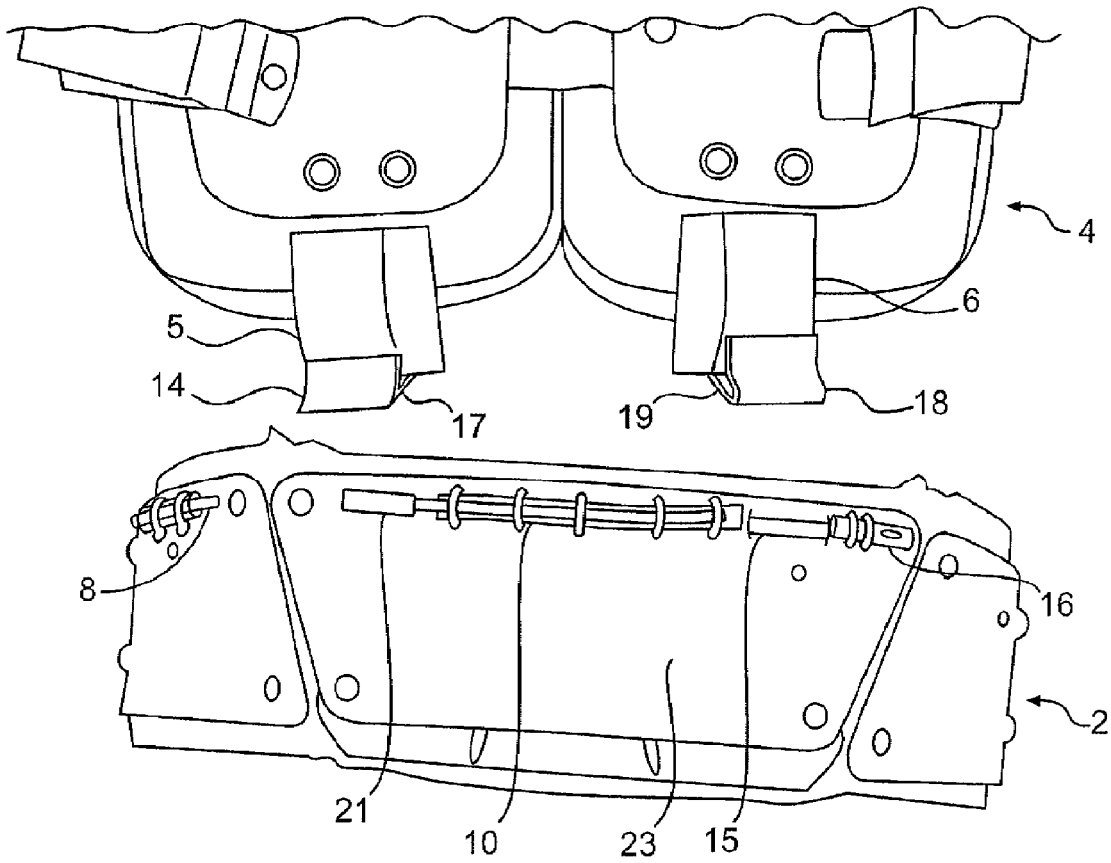
FIG. 4 illustrates a distal plan view of the same embodiment of the present invention as shown in FIG. 1, in which the removable elongated coupler is removed from both protective rib and lower back pad retaining loops and both protective rib and lower back pad retaining loops are evacuated from the protective rib and lower back pads retention apertures, thus detaching or decoupling the protective rib and lower back pads from the protective shoulder pads.

Turning to FIG. 4, elongated coupler 8 is further removed from protective rib and lower back pads 2. In this view, the second or posterior portion of elongated coupler 8 is removed from terminating channel 16, orifice 19 of right retaining loop 18, cable guidance channel 10, and orifice 14 of left retaining loop 14. Left retaining loop 14 is released and may now egress or pass back through left retention aperture 21 in protective rib and lower back pads 2, and right retaining loop 18 is released and may now pass through right retention aperture 15 in protective rib and lower back pads 2. Removable elongated coupler 8 was routed through orifice 19 in right retaining loop 18 and through orifice 17 in left retaining loop 14. In this state, protective rib and lower back pads 2 may be completely disconnected or decoupled from protective shoulder pads 4.

Protective shoulder pads 4 and protective rib and lower back pads 2 may be recoupled for future use by passing left terminating loop 14 through the left retention aperture 21 in protective rib and lower back pads 2 and right retaining loop 18 through right retention aperture 15 in protective rib and lower back pads 2 followed by passing or threading removable elongated coupler 8 through orifice 17 in left retaining loop 14, through cable guidance channel 10, through orifice 19 in right retaining loop 18 and finally into terminating channel 16.

To effectuate or facilitate the removal of retaining loops 18, 14 from retention apertures 15, 21 in protective rib and lower back pads 2, loops 18, 14 may be constructed of a pliable material that is cable of passing through retention apertures 15, 21 while the individual wearing protective rib and lower back pads 2 is in the supine position. In one embodiment, retaining loops 18, 14 are riveted to straps 6, 5. Retaining loops 18, 14 could optionally be manufactured into straps 6, 5 as one piece or connected by any other suitable means, including, but not limited to rivets, snaps, hook and loop fastener, glue, etc. By way of example, retaining loops 18, 14 may be composed of Nylon, but any other pliable material capable of restraining retaining loops 18, 14 is acceptable. Another feature of straps 6, 5 is the material that the strap other than retaining loops 18, 14 may be composed of. It is generally desirable to produce straps 6, 5 from a material that will not absorb moisture such as water or perspiration. Straps 6, 5 of this embodiment of protective rib and lower back pads 2 are composed of nonabsorbent plastic; however, other material may be utilized, whether the material is nonabsorbent or not.

Figure 5:
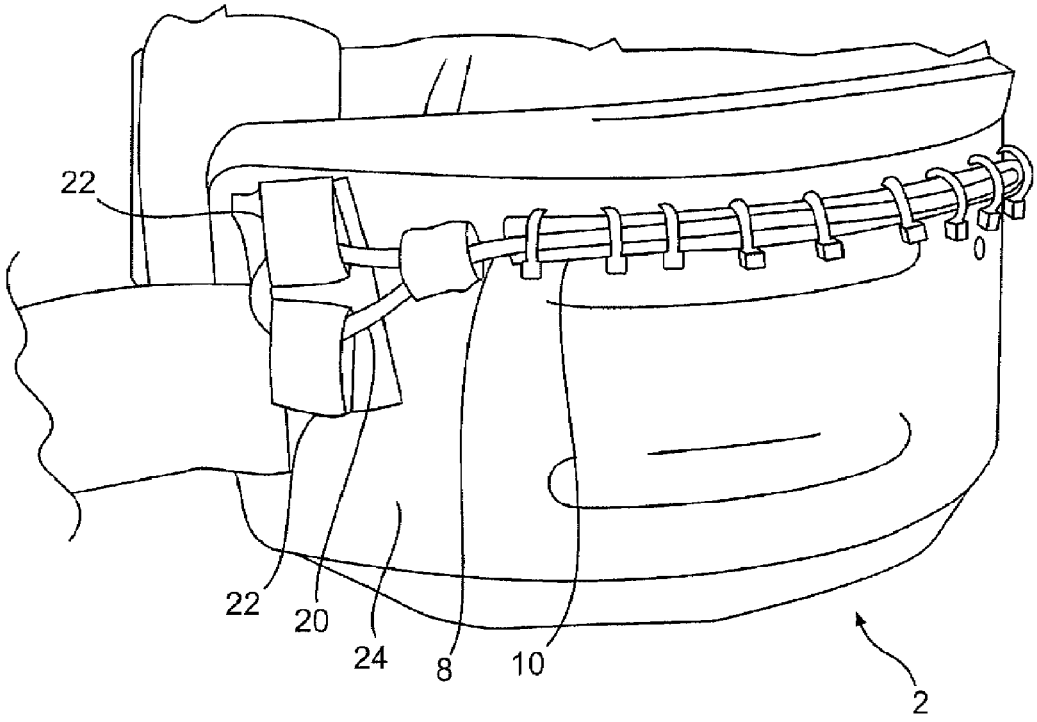
FIG. 5 illustrates a lateral prospective view of an embodiment of the present invention illustrated in FIG. 1, in which a loop on the anterior end of the elongated coupler is used to remove the elongated coupler from the straps that couple the protective rib and lower back pads to the protective shoulder pads.

FIG. 5 illustrates a gripping structure, for example, a loop, disposed on the first or anterior end 20 of elongated coupler 8. This gripping structure may be used to assist in the removal of elongated coupler 8 from cable guidance channel 10, retaining loops 18, 14, and terminating channel 16 of protective rib and lower back pads 2. The gripping structure may be retained in place on anterior portion 24 of pads 2 by a retention mechanism 22. Retention mechanism 22 may be composed of a hook and loop fastener or other suitable type of fastener. Anterior end 20 of elongated coupler 8 is accessible from anterior portion 24 of the shoulder and/or rib pads to allow extraction of elongated coupler 8 while the wearer is in the supine position.

It will be apparent to those skilled in the art that variations and modifications of the present invention can be made without departing from the scope or spirit of the invention. Thus, it is intended that the present invention cover all such modifications and variations of the invention, provided they come within the scope of the appended claims and their equivalents. For example, the release mechanism may comprise one strap with one loop, one orifice, and one aperture. In addition, the first end of the strap may be connected to the shoulder pad and the aperture disposed on the rib/back pad, or in an alternative embodiment, the first end of the strap may be connected to the rib/back pad and the aperture disposed on the shoulder pad.

The invention claimed is:

1. Protective pads wearable by an individual for use in a contact sport, the protective pads comprising:

a first pad assembly having an anterior portion and a posterior portion;

a second pad assembly having a posterior portion and an anterior portion; and an elongated coupler releasably coupling the posterior portion of the second pad assembly to the posterior portion of the first pad assembly, the elongated coupler including an anterior segment that is accessible from the anterior portion of the second pad assembly and that is operable to decouple the second pad assembly from the first pad assembly while an individual wearing the first and second pad assemblies is in the supine position.

2. The pads of claim 1, wherein the posterior portion of the first pad assembly includes a strap, and wherein the elongated coupler extends through the strap to releasably couple the posterior portion of the second pad assembly to the posterior portion of the first pad assembly.

3. The pads of claim 2, wherein the posterior portion of the second pad assembly includes a retention aperture, wherein the strap threads through the retention aperture and is retained in the retention aperture by the elongated coupler, and wherein the strap is released from the retention aperture by operation of the anterior segment of the elongated coupler.

4. The pads of claim 1, wherein the elongated coupler includes a posterior segment, and wherein the posterior segment of the elongated coupler releasably couples the posterior portion of the second pad assembly to the posterior portion of the first pad assembly.

5. The pads of claim 4, wherein the posterior segment of the elongated coupler substantially traverses the posterior portion of the second pad assembly.

6. The pads of claim 1, wherein the first pad assembly comprises a shoulder pad assembly, and wherein the second pad assembly comprises a rib and lower back pad assembly.

7. The pads of claim 1, wherein the anterior segment of the elongated coupler includes a first end of the elongated coupler that is disposed on and accessible from the anterior portion of the second pad assembly when the second pad assembly is coupled to the first pad assembly.

8. Protective pads wearable by an individual for use in a contact sport, the protective pads comprising:

a first pad assembly having an anterior portion, a superior portion and a posterior portion, wherein a first end of the anterior portion is in communication with a first end of the superior portion, and a first end of the posterior portion is in communication with a second end of the superior portion;

a second pad assembly having a posterior portion and an anterior portion; and a release mechanism including a first portion provided on the posterior portion of the first pad assembly and a second portion releasably coupled with the first portion and provided on the posterior portion of the second pad assembly, the release mechanism further including an elongated coupler including an anterior segment accessible from the anterior portion of the second pad assembly, wherein the anterior segment of the elongated coupler is operable to decouple the first portion of the release mechanism from the second portion of the release mechanism, thereby decoupling the posterior portion of the first pad assembly from the posterior portion of the second pad assembly while maintaining the neck and spine of the individual in the substantially neutral position.

9. The pads of claim 8, wherein the first portion of the release mechanism includes a strap, and wherein the elongated coupler extends through the strap to releasably couple the first portion of the release mechanism to the second portion of the release mechanism.

10. The pads of claim 9, wherein the second portion of the release mechanism includes a retention aperture, wherein the strap threads through the retention aperture and is retained in the retention aperture by the elongated coupler, and wherein the strap is released from the retention aperture by operation of the anterior segment of the elongated coupler.

11. The pads of claim 8, wherein the elongated coupler includes a posterior segment, and wherein the posterior segment of the elongated coupler releasably couples the first portion of the release mechanism to the second portion of the release mechanism.

12. The pads of claim 11, wherein the posterior segment of the elongated coupler substantially traverses the posterior portion of the second pad assembly.

13. The pads of claim 8, wherein the first pad assembly comprises a shoulder pad assembly, and wherein the second pad assembly comprises a rib and lower back pad assembly.

14. The pads of claim 8, wherein the anterior segment of the elongated coupler includes a first end of the elongated coupler that is disposed on and accessible from the anterior portion of the second pad assembly when the second pad assembly is coupled to the first pad assembly.

15. Protective pads wearable by an individual for use in a contact sport, the protective pads comprising:

a first pad assembly having an anterior portion and a posterior portion;

a second pad assembly having a posterior portion and an anterior portion; and a release mechanism including a first portion provided on the posterior portion of the first pad assembly and a second portion releasably coupled with the first portion and provided on the posterior portion of the second pad assembly, the release mechanism further including an elongated coupler including a posterior segment and an anterior segment, wherein the anterior segment of the elongated coupler is operable to decouple the first portion of the release mechanism from the second portion of the release mechanism while an individual wearing the coupled first and second pad assemblies is in the supine position.

16. The pads of claim 15, wherein the first portion of the release mechanism includes a strap, and wherein the posterior segment of the elongated coupler extends through the strap to releasably couple the first portion of the release mechanism to the second portion of the release mechanism.

17. The pads of claim 16, wherein the second portion of the release mechanism includes a retention aperture, wherein the strap threads through the retention aperture and is retained in the retention aperture by the posterior segment of the elongated coupler, and wherein the strap is released from the retention aperture by operation of the anterior segment of the elongated coupler.

18. The pads of claim 15, wherein the posterior segment of the elongated coupler substantially traverses the posterior portion of the second pad assembly and releasably couples the first portion of the release mechanism to the second portion of the release mechanism.

19. The pads of claim 15, wherein the first pad assembly comprises a shoulder pad assembly, and wherein the second pad assembly comprises a rib and lower back pad assembly.

20. The pads of claim 15, wherein the anterior segment of the elongated coupler includes a first end of the elongated coupler that is disposed on and accessible from the anterior portion of the second pad assembly when the second pad assembly is coupled to the first pad assembly.

* * * * *